US008104873B2

(12) United States Patent
Nagata

(10) Patent No.: US 8,104,873 B2
(45) Date of Patent: Jan. 31, 2012

(54) RECORDING HEAD

(75) Inventor: Shingo Nagata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 361 days.

(21) Appl. No.: 12/510,180

(22) Filed: Jul. 27, 2009

(65) Prior Publication Data

US 2010/0026762 A1 Feb. 4, 2010

(30) Foreign Application Priority Data

Jul. 29, 2008 (JP) ..... 2008-194873

(51) Int. Cl.
*B41J 2/14* (2006.01)
*B41J 2/16* (2006.01)

(52) U.S. Cl. ..... 347/50; 347/58; 347/59

(58) Field of Classification Search ..... 347/40–43, 347/49, 50, 58–59, 64–65, 67, 71, 84–85, 347/94

See application file for complete search history.

(56) References Cited

U.S. PATENT DOCUMENTS

| | | | | |
|---|---|---|---|---|
| 6,474,789 | B1 * | 11/2002 | Ishinaga et al. | 347/59 |
| 6,736,492 | B2 * | 5/2004 | Yamada et al. | 347/71 |
| 2003/0048328 | A1 | 3/2003 | Inamoto | |

FOREIGN PATENT DOCUMENTS

| | | |
|---|---|---|
| JP | 10-157150 | 6/1998 |
| JP | 11-138817 | 5/1999 |
| JP | 2003-80717 | 3/2003 |

* cited by examiner

*Primary Examiner* — Thinh Nguyen
(74) *Attorney, Agent, or Firm* — Canon USA Inc IP Division

(57) ABSTRACT

A recording head includes a substrate provided with a recording element that generates energy for ejecting liquid and electrical wiring that supplies power to the recording element; and a passage-forming member provided in contact with one face of the substrate and having a nozzle for ejecting the liquid and a passage for supplying the liquid to the nozzle. A groove formed by a through-hole provided in the passage-forming member is disposed such that a bottom face of the groove is located along and above the electrical wiring and positioned so as not to overlap an edge of the electrical wiring.

10 Claims, 11 Drawing Sheets

RECORDING HEAD

BACKGROUND OF THE INVENTION

1. Field of the Invention

The present invention relates to recording heads that perform recording by ejecting liquid, such as ink.

2. Description of the Related Art

Recording heads perform recording by ejecting liquid, such as ink. One known liquid ejecting method of a recording head is an inkjet method. In a typical example of an inkjet method, liquid is ejected by film-boiling the liquid using heat-generating resistors acting as recording elements. By ejecting the liquid towards a recording medium in this manner, recording can be performed on the recording medium.

A recording head normally includes a substrate and a passage-forming member having one or more nozzles. The passage-forming member is joined to the substrate. The substrate has an opening serving as a liquid supply port. The substrate is provided with recording elements arranged at positions corresponding to the respective nozzles. The substrate is also provided with electrical wiring for supplying power to the recording elements.

The liquid supply port in the substrate and the nozzles in the passage-forming member are in communication with each other through a passage. The liquid is supplied to the passage from the liquid supply port and is ejected from the nozzles by the operation of the recording elements.

Japanese Patent Laid-Open Nos. 10-157150 and 11-138817 disclose methods for manufacturing recording heads. These manufacturing methods include a step for applying a resin coating, which is to become the passage-forming member, onto a substrate having recording elements by, for example, spin-coating.

The resin coating that is to become the passage-forming member is thermally cured. The heat produced during this thermal curing process generates a large amount of stress on the passage-forming member, causing the passage-forming member to become readily detached from the substrate. Detachment of the passage-forming member becomes more prominent as the recording head is increased in length or as the passage-forming member is increased in thickness.

Japanese Patent Laid-Open No. 2003-80717 discusses an approach for preventing the detachment of the passage-forming member. Specifically, the passage-forming member is provided with a plurality of through-holes and a groove in order to reduce the volume of the passage-forming member. This can alleviate stress generated in the passage-forming member so as to prevent the passage-forming member from becoming detached.

Japanese Patent Laid-Open No. 2003-80717 also includes a description concerning an approach for preventing the detachment of the passage-forming member by providing the groove with serrated sidewalls.

In Japanese Patent Laid-Open No. 2003-80717, a recording head having a through-hole formed in the passage-forming member is discussed. The passage-forming member is joined to the substrate so that a groove is formed by the through-hole. However, a certain amount of stress is generated at the edges of the bottom face of this groove and may sometimes cause the passage-forming member to become slightly detached from the substrate.

In the case where there are protrusions and recesses formed at an interface between the substrate and the passage-forming member, slight detachment of the passage-forming member may occur if the bottom face of the groove is located in an area of the substrate with sharp or severe protrusions and recesses.

The electrical wiring formed in the substrate is one of the factors that form protrusions and recesses at the interface between the substrate and the passage-forming member. In other words, step portions are formed along the edges of the electrical wiring. When the substrate having such step portions is coated with a protective film, the thickness of the protective film covering these step portions is smaller than the thickness of the protective film covering the flat portions.

The present inventor discovered that the following problems occur in such a case.

When high voltage is frequently applied to the electrical wiring, the thin protective film covering the step portions tend to become thermally deformed, become fragile, or crack. For this reason, the protective film can lose its function of protecting the electrical wiring.

In this case, if an area of the passage-forming member having a hole extending therethrough or a detached area of the passage-forming member is located at a thin section of the protective film, the electrical wiring becomes exposed to liquid and moisture. When high voltage is applied to the electrical wiring in this state, electrolytic corrosion can occur on the electrical wiring.

SUMMARY OF THE INVENTION

The present invention provides a highly reliable recording head that can minimize corrosion of electrical wiring.

A recording head includes a substrate provided with a recording element that generates energy for ejecting liquid and electrical wiring that supplies power to the recording element; and a passage-forming member provided in contact with one face of the substrate and having a nozzle for ejecting the liquid and a passage for supplying the liquid to the nozzle. A groove formed by a through-hole provided in the passage-forming member is disposed such that a bottom face of the groove is located along and above the electrical wiring and positioned so as not to overlap an edge of the electrical wiring.

According to the present invention, a highly reliable recording head that can minimize corrosion of electrical wiring can be provided.

Further features of the present invention will become apparent from the following description of exemplary embodiments with reference to the attached drawings.

DESCRIPTION OF THE EMBODIMENTS

Embodiments of the present invention will be described below with reference to the drawings.

A recording head according to the present invention can be applied to a common printing device, a copying device, a facsimile device having a communication system, a recording device, such as a word processor, having a printing unit, or a multifunction recording apparatus having a combination of these recording devices.

The recording head is equipped with a recording-element substrate having recording elements that generate energy for ejecting liquid. As an example of a recording element, an electro-thermal transducer that generates thermal energy for film-boiling the liquid may be used.

First Embodiment

Figure 1A:
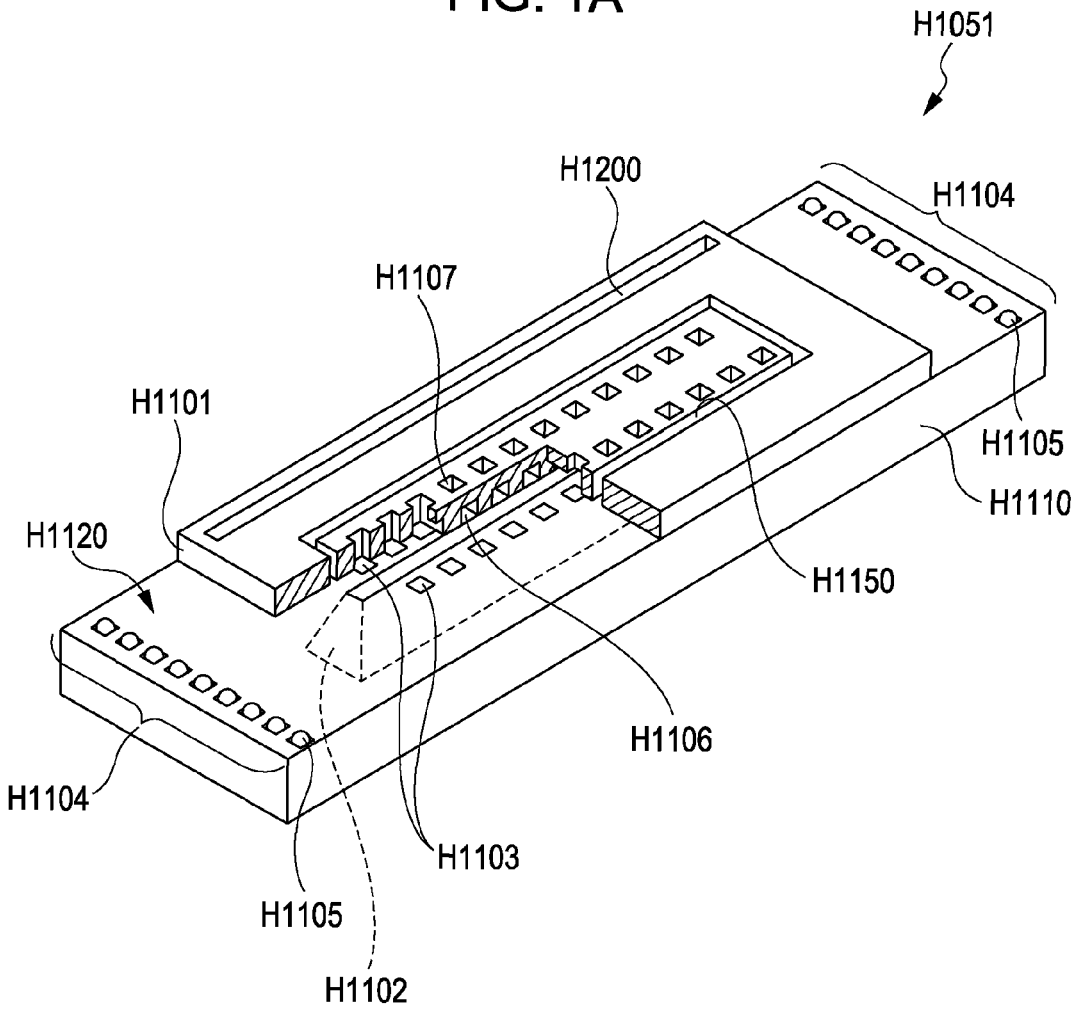
FIG. 1A is a partial-cutaway perspective view schematically showing a recording-element substrate included in a recording head according to a first embodiment.
Figure 1B:
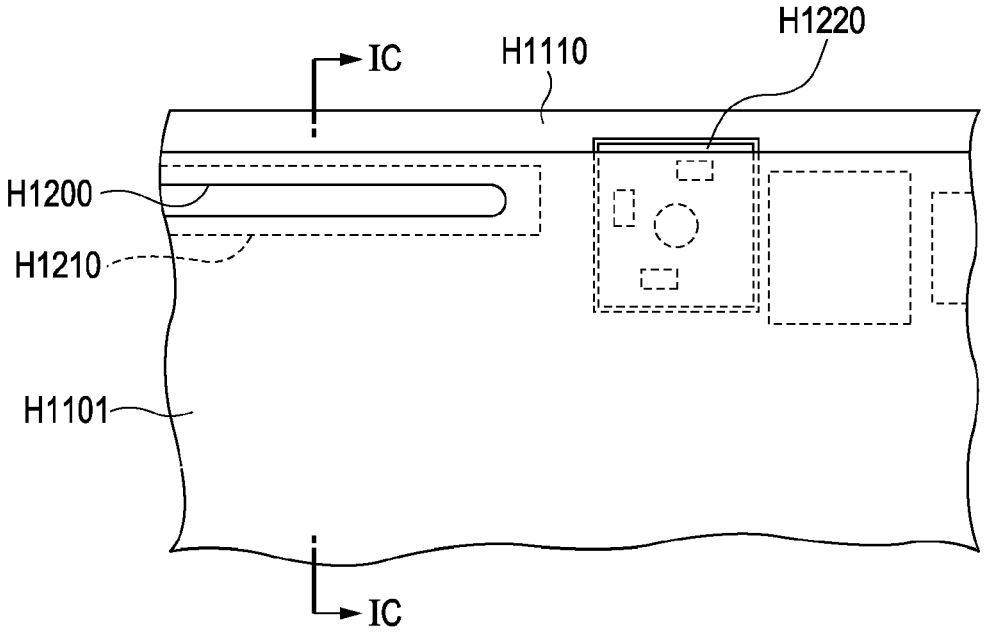
FIG. 1B is a plan view schematically showing the recording-element substrate, as viewed toward a nozzle face thereof.
Figure 1C:
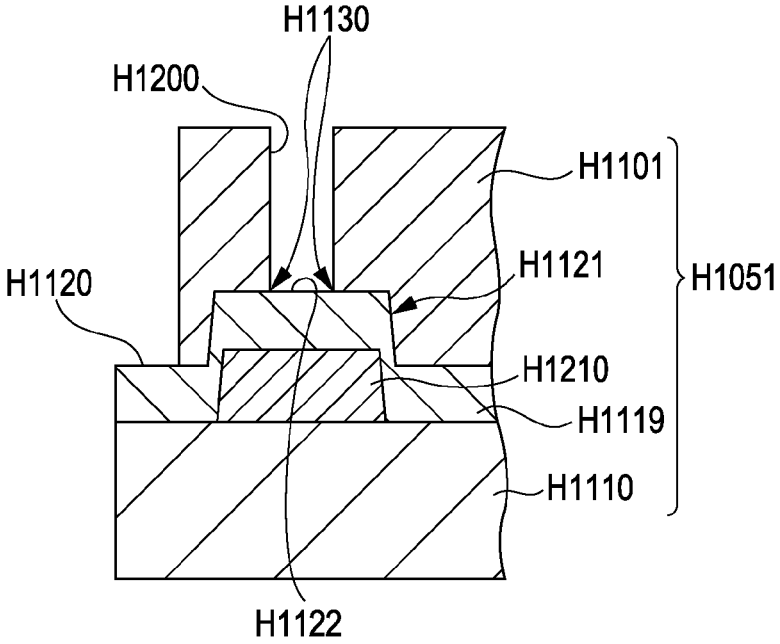
FIG. 1C is a cross-sectional view schematically showing the recording-element substrate, as taken along line IC-IC in FIG. 1B.

FIG. 1A is a partial-cutaway perspective view schematically showing a recording-element substrate. FIG. 1B is a plan view schematically showing a region near an end of a groove H1200 formed in the recording-element substrate shown in FIG. 1A, as viewed toward a nozzle face thereof having nozzles. FIG. 1C is a cross-sectional view schematically showing the recording-element substrate, as taken along line IC-IC in FIG. 1B.

A recording-element substrate H1051 includes a substrate H1110 having recording elements H1103 that generate energy for ejecting liquid, and a passage-forming member H1101. The substrate H1110 may be composed of, for example, silicon (Si). In this embodiment, the recording-element substrate H1051 is long in one direction, which means that it has an oblong shape.

The substrate H1110 has a liquid supply port H1102 extending through the substrate H1110. The liquid supply port H1102 can be formed by, for example, anisotropic etching or sandblasting, which utilizes the crystal orientation of the material used for forming the substrate H1110.

The passage-forming member H1101 is joined to one face H1120 of the substrate H1110. The recording elements H1103 are arranged at the one face H1120 of the substrate H1110. The passage-forming member H1101 is composed of a resin material. The passage-forming member H1101 has a passage H1106 and nozzles H1107 formed therein by photolithography.

The passage H1106 is provided for introducing liquid from the liquid supply port H1102 to a liquid chamber in which the recording elements H1103 are arranged. The nozzles H1107 serve as openings for ejecting the liquid in the liquid chamber outward.

The nozzles H1107 are formed in a surface of the passage-forming member H1101 facing away from the one face H1120 of the substrate H1110.

The substrate H1110 is provided with, for example, electrical wiring, fuses (not shown), and electrode units H1104. The electrode units H1104, which are for supplying power to the electrical wiring, are each provided with a bump H1105 composed of, for example, gold (Au). The electrical wiring can be formed by using, for example, an aluminum-copper (Al—Cu) alloy or aluminum (Al).

For example, in this embodiment, the passage-forming member H1101 has a thickness of about 70 μm, the nozzles H1107 each have a diameter of about 21.7 μm, and the passage (not shown) has a width of about 52 μm in the thickness direction. Furthermore, the recording elements H1103 each have a rectangular shape with dimensions of about 34.8 μm by 37.2 μm within a plane parallel to the nozzle face.

The one face H1120 of the substrate H1110 is provided with an alignment mark H1220. The alignment mark H1220 is provided for positioning the recording-element substrate H1051 with respect to a holding member, to be described later, which holds the recording-element substrate H1051.

A through-hole that extends through the passage-forming member H1101 is formed adjacent to one edge of the passage-forming member H1101 in a direction orthogonal to the longitudinal direction thereof. This through-hole and the substrate H1110 together form the groove H1200 in the recording-element substrate H1051. Although the groove H1200 is formed adjacent to the one edge in the orthogonal direction in FIGS. 1A to 1C, two grooves H1200 may be respectively formed adjacent to both of the edges in the orthogonal direction. The groove H1200 is provided for alleviating stress generated in the passage-forming member H1101.

The substrate H1110 includes at least one wiring layer constituted by the electrical wiring. In this embodiment, two wiring layers are provided in the substrate H1110. FIGS. 1B and 1C only show electrical wiring H1210 that constitutes a wiring layer located closest to the one face H1120.

The one face H1120 of the substrate H1110 is provided with a protective film H1119. A projection H1121 having a top face H1122 is formed on the one face H1120 of the substrate H1110 due to the electrical wiring H1210 constituting the wiring layer located closest to the one face H1120.

The top face H1122 is formed in conformity to the surface of the electrical wiring H1210 closer to the one face H1120 and is relatively flat (see FIG. 1C). On the other hand, side faces of the projection H1121 tend to be steep slopes, and the thickness of the protective film H1119 covering these side faces is small. For this reason, the protective film H1119 covering these side faces of the projection H1121 tend to become deformed, become fragile, or crack.

In this embodiment, the bottom face of the groove H1200 is located at the top face H1122 of the projection H1121. In other words, the bottom face of the groove H1200 is located above the upper face of the electrical wiring H1210. The width of the groove H1200 is smaller than that of the electrical wiring H1210, so that the bottom face of the groove H1200 does not overlap the side faces of the projection H1121.

In this embodiment, the groove H1200 has a width of, for example, about 30 μm.

According to the above configuration, the protective film H1119 located adjacent to the side faces of the projection H1121 is thickly covered with the passage-forming member H1101. Therefore, even if the protective film H1119 adjacent to the side faces of the projection H1121 becomes thermally deformed, becomes fragile, or cracks, the electrical wiring H1210 can still be prevented from being exposed to external liquid or moisture. Consequently, the occurrence of electrolytic corrosion of the electrical wiring H1210 can be minimized, thereby providing a highly reliable recording head.

Electrical wiring (not shown) that constitutes a wiring layer different from the wiring layer located closest to the one face H1120 does not have much effect on the topography of the one face H1120 of the substrate H1110. This is because there are multiple layers, such as an insulating layer and other wiring layers, formed between the electrical wiring constituting the different wiring layer and the one face H1120.

In this embodiment, the electrical wiring H1210 has a thickness of, for example, about 0.35 μm. Furthermore, the electrical wiring H1210 is formed along the longitudinal direction of the recording-element substrate H1051, and the width of the electrical wiring H1210 in the direction orthogonal to the longitudinal direction thereof is about 63.5 μm.

Even if the passage-forming member H1101 becomes slightly detached from the substrate H1110 at edges H1130 of the bottom face of the groove H1200, the edges H1130 of the groove H1200 will not reach the positions corresponding to the side faces of the projection H1121 since the width of the groove H1200 is smaller than that of the electrical wiring H1210. This means that the thin sections of the protective film H1119 remain covered by the passage-forming member H1101. Therefore, corrosion of the electrical wiring can be minimized.

A recording head was actually fabricated using the above-described recording-element substrate H1051 to examine the degree of detachment of the passage-forming member H1101. According to a detailed examination implemented on the fabricated recording head, slight detachment was confirmed at the edges H1130 of the bottom face of the groove H1200. However, the detached areas of the passage-forming member H1101 did not extend to the positions corresponding to the side faces of the projection H1121.

The following test was implemented on the recording head in the above state to check the degree of corrosion of the electrical wiring H1210. First, the recording head was immersed in a black liquid containing a carbon black pigment as a coloring material for five days in an environment with the temperature at 60° C. and the humidity at 90%. Subsequently, with a voltage of 24 V applied to the electrical wiring H1210, the recording head was left for 300 hours in the 60° C. temperature, 90% humidity environment.

After the above-described test, the electrical wiring H1210 was examined in detail but was confirmed to have no corrosion.

The groove H1200 may be disposed at any position so long as the bottom face of the groove H1200 does not overlap the edges of the electrical wiring H1210. Accordingly, the protective film H1119 located adjacent to the side faces of the projection H1121 can be thickly covered with the passage-forming member H1101.

However, since the electrical wiring H1210 is wired substantially throughout the substrate H1110, it is difficult to form the groove H1200 in an area free of the projection H1121, which is formed due to the electrical wiring H1210. Therefore, it is preferable that the groove H1200 be formed along the electrical wiring H1210, as described above.

The passage-forming member H1101 is provided with another groove H1150 that surrounds the nozzles H1107 and the passage H1106. The groove H1150 alleviates stress generated near the passage H1106 so as to prevent the passage-forming member H1101 near the passage H1106 from becoming detached from the substrate H1110.

Figure 2:
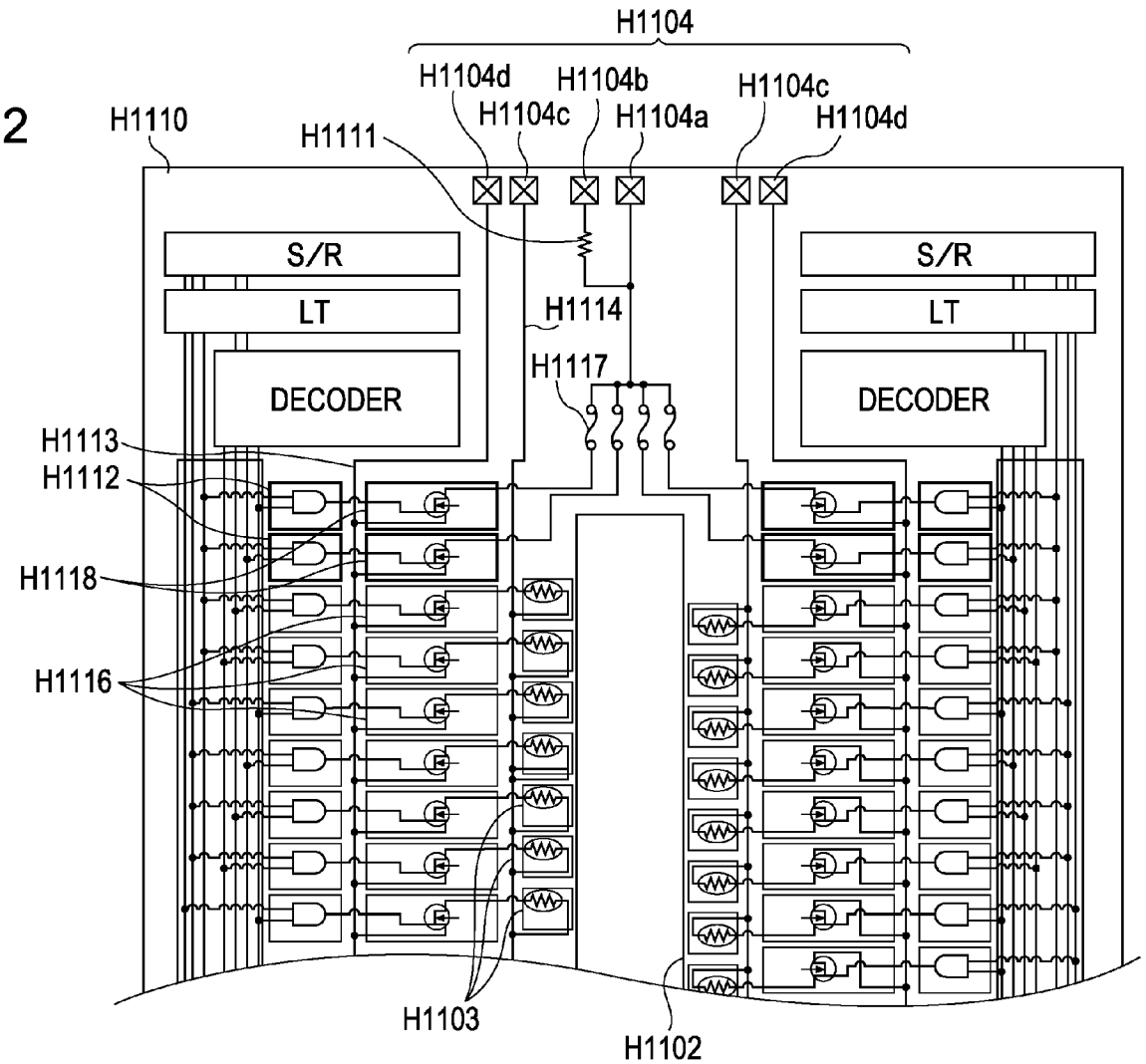
FIG. 2 schematically illustrates a substrate included in the recording head.

A circuit formed in the substrate H1110 will now be described. FIG. 2 schematically illustrates the circuit formed in the substrate H1110.

One end of each recording element H1103 is connected to a corresponding VH power-supply pad H1104*c*, which is for supplying VH power, via a corresponding VH power-supply wire H1114. The other end of the recording element H1103 is connected to a corresponding first driver H1116.

The first drivers H1116 are each connected to a corresponding GNDH power-supply pad H1104*d*, which is for supplying GNDH power, via a corresponding GNDH power-supply wire H1113. The first drivers H1116 each drive the corresponding recording element H1103 in accordance with a signal received from a signal line, which receives the signal from outside the substrate H1110, via a corresponding shift register (S/R), a corresponding latch circuit (LT), a corresponding decoder, and a corresponding selection circuit H1112.

The substrate H1110 also has fuses H1117 for holding information specific to the recording head. The fuses H1117 are formed of, for example, polysilicon resistors and are arranged beside a lateral side of the liquid supply port H1102.

One end of each fuse H1117 is connected to an ID pad 1104*a* and is also connected to an ID power-supply pad H1104*b* via a readout resistor H1111.

The substrate H1110 has second drivers H1118 for selectively blowing out the fuses H1117 and selectively reading out information indicating whether or not the fuses H1117 are blown out. The second drivers H1118 are connected to the other end of each fuse H1117.

The second drivers H1118 are arranged in a direction in which arrays formed by the first drivers H1116 extend. The second drivers H1118 are each connected to a circuit having the same structure as a circuit that generates a selection signal to be sent to each first driver H1116.

In this embodiment, the first drivers H1116 and the second drivers H1118 in the left half of the circuit in the substrate H1110 shown in FIG. 2 share the corresponding shift register (S/R), the corresponding latch circuit (LT), and the corresponding decoder. Therefore, the operation of the first drivers H1116 and the second drivers H1118 can be similarly controlled using a signal received from the outside via a common signal line. The same applies to the right half of the circuit in the substrate H1110 shown in FIG. 2.

Selection circuits that ultimately select the second drivers H1118 on the basis of a signal output from the shift register, etc. has the same configuration as the selection circuits H1112 for the first drivers H1116.

The VH power-supply wires H1114 extending from the VH power-supply pads H1104*c* for supplying VH power to the recording elements H1103 are connected to the recording elements H1103. The GNDH power-supply wires H1113 extending from the GNDH power-supply pads H1104*d* for supplying GNDH power are shared by the first drivers H1116 connected to the recording elements H1103 and the second drivers H1118 connected to the fuses H1117.

The following description relates to the blowout of the fuses H1117 and the readout of information from the fuses H1117.

When the fuses H1117 are to be blown out, the ID pad 1104*a* functions as a fuse-disconnecting power-supply terminal that applies a voltage capable of blowing out the fuses H1117. Specifically, a voltage (of, for example, 24 V, which is a driving voltage for the recording elements) is applied to the ID pad 1104*a* so that second drivers H1118 selected via the selection circuits H1112 are driven, thereby blowing out the corresponding fuse or fuses H1117.

In this case, the ID power-supply pad H1104*b* serving as a fuse-readout power-supply terminal is maintained in an open state.

On the other hand, when information is to be read out based on the fuses, the ID pad 1104*a* functions as a signal output terminal. In detail, when the information is to be read out, a different voltage (of, for example, 3.3 V, which is a power-supply voltage for a logic circuit) is applied to the ID power-supply pad H1104*b*. In this case, if the corresponding fuse or fuses H1117 is/are blown out, a high-level output is sent to the ID pad 1104*a*, whereas if the corresponding fuse or fuses H1117 is/are not blown out, a low-level output is sent to the ID pad 1104*a* since the resistance value of the readout resistor H1111 is significantly greater than the resistance value of the fuse or fuses H1117.

Figure 3A:
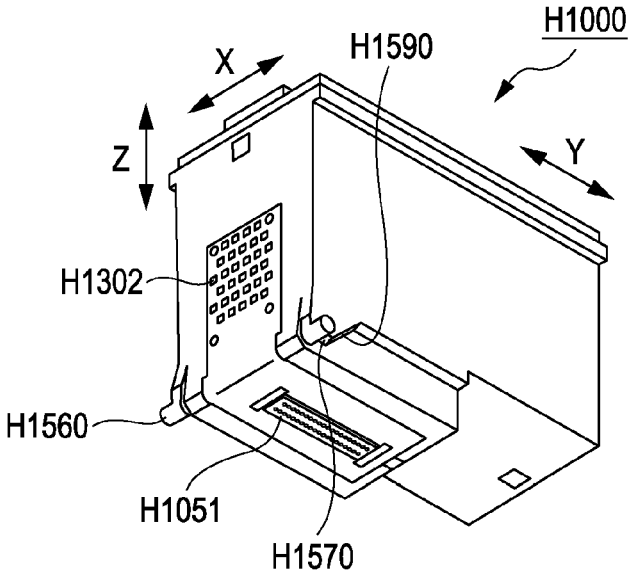
FIGS. 3A and 3B are perspective views schematically illustrating the recording head according to this embodiment.
Figure 3B:
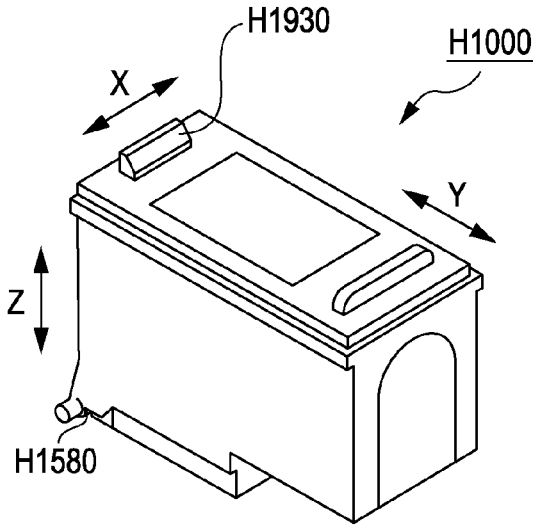
Figure 4A:
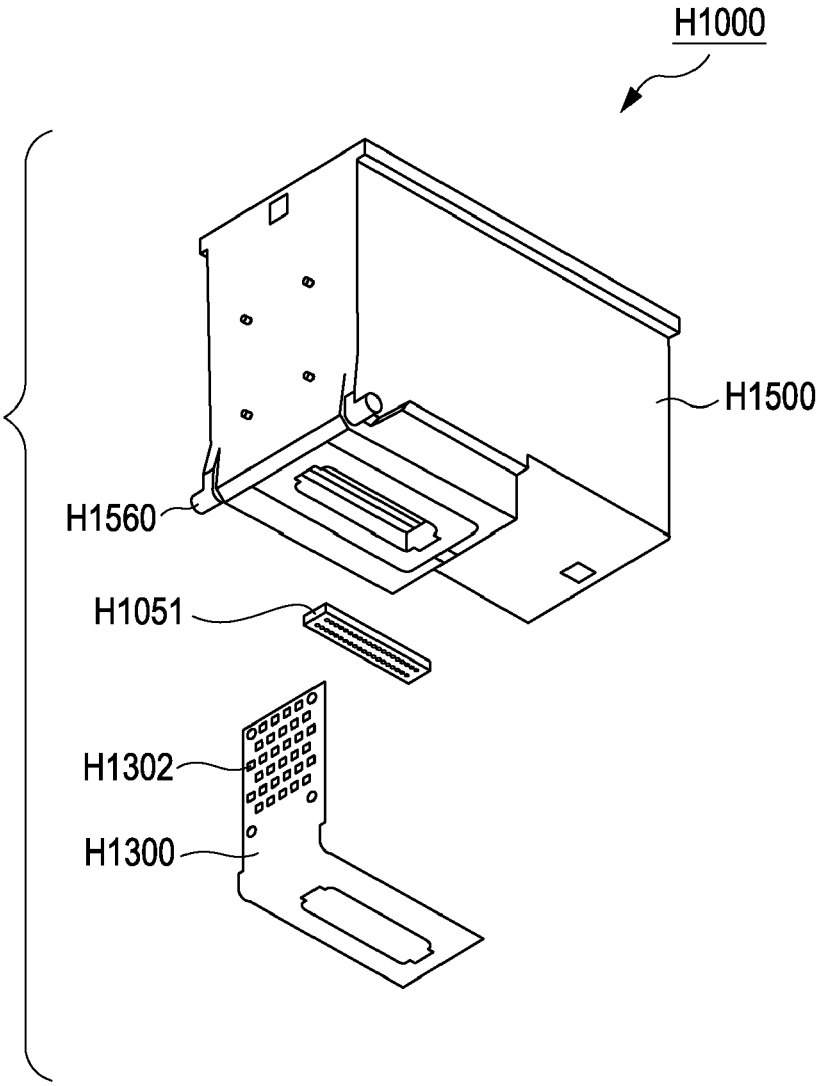
FIGS. 4A and 4B are exploded perspective views of the recording head according to this embodiment.
Figure 4B:
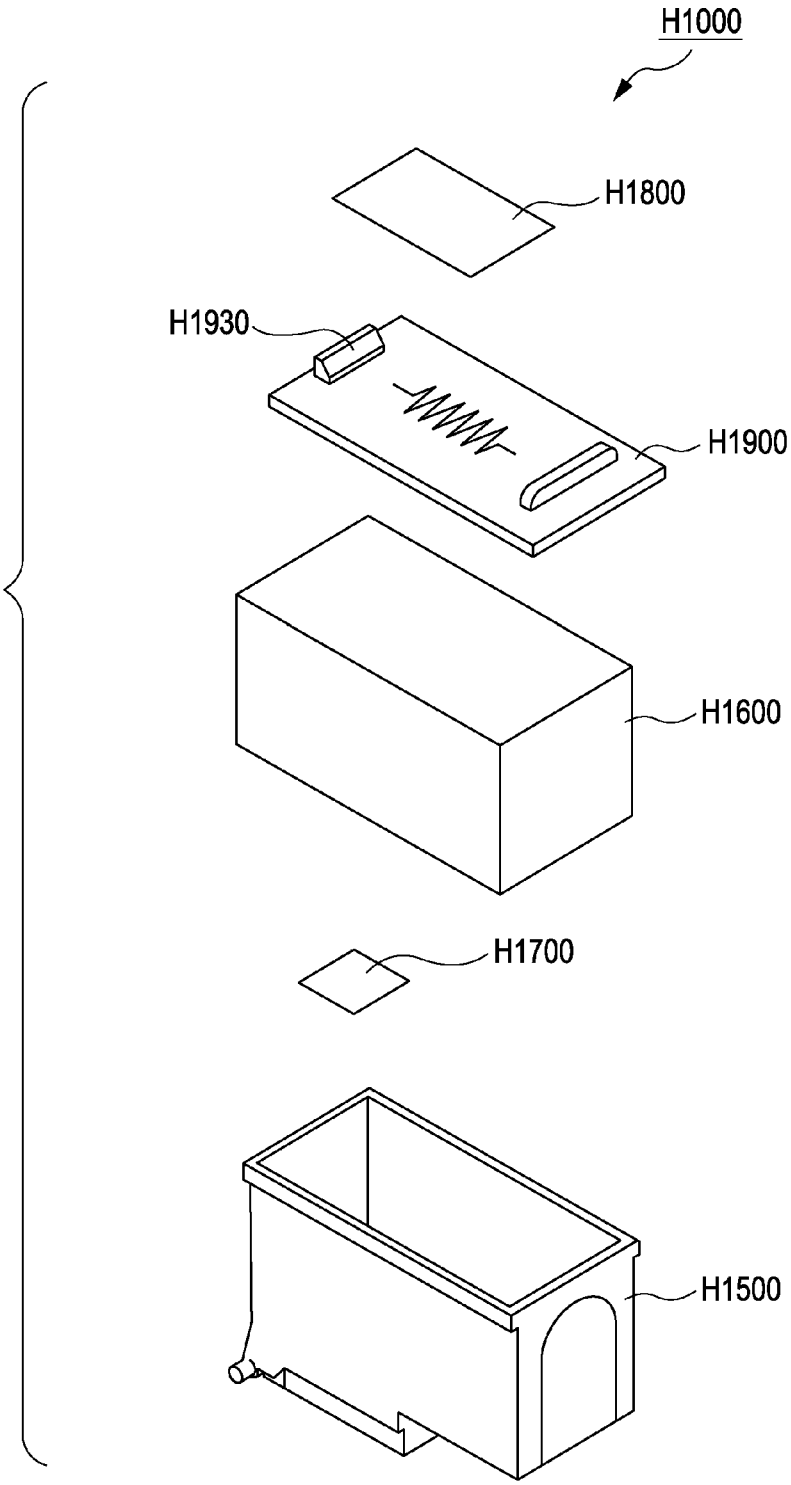

An example of a recording head having the above-described recording-element substrate H1051 will now be described. FIGS. 3A and 3B are perspective views schematically illustrating a recording head H1000 according to this embodiment. FIGS. 4A and 4B are exploded perspective views of the recording head H1000.

The recording head H1000 according to this embodiment is a cartridge-type recording head having a combination of a liquid reservoir that stores liquid and a recording-element substrate.

The recording head H1000 includes the recording-element substrate H1051, a holding member H1500 that holds the recording-element substrate H1051, and electrical-wiring tape H1300. The holding member H1500 is box-shaped and also serves as a liquid reservoir for storing liquid to be ejected.

A filter 1700 and a liquid absorber H1600 are installed inside the holding member H1500. The recording head H1000 has a cover member H1900 for the holding member H1500. The cover member H1900 has a sealing member H1800 attached thereto.

The holding member H1500 is provided with a mounting guide H1560, an engaging portion H1930, and first, second, and third stopper portions H1570, H1580, and H1590.

The mounting guide H1560 is provided for guiding the recording head H1000 to a carriage, to be described later, when fitting the recording head H1000 thereto. In this case, the engaging portion H1930 is fixed to the carriage by using a head set lever. The carriage is provided in a recording device equipped with the recording head H1000.

The stopper portions H1570, H1580, and H1590 are provided for positioning the recording head H1000 with respect to the carriage. The first stopper portion H1570 is used for positioning the recording head H1000 in the moving direction (i.e., in a direction indicated by an arrow X in FIGS. 3A and 3B) of the carriage. The second stopper portion H1580 is used for positioning the recording head H1000 in the conveying direction (i.e., in a direction indicated by an arrow Y) of a recording medium. The third stopper portion H1590 is used for positioning the recording head H1000 in the liquid-ejecting direction (i.e., in a direction indicated by an arrow Z).

By positioning the recording head H1000 with respect to the carriage using the stopper portions H1570, H1580, and H1590, an external-signal input terminal H1302 on the electrical-wiring tape H1300 can be properly brought into electrical contact with a contact pin of an electrical connection section provided within the carriage.

Figure 5:
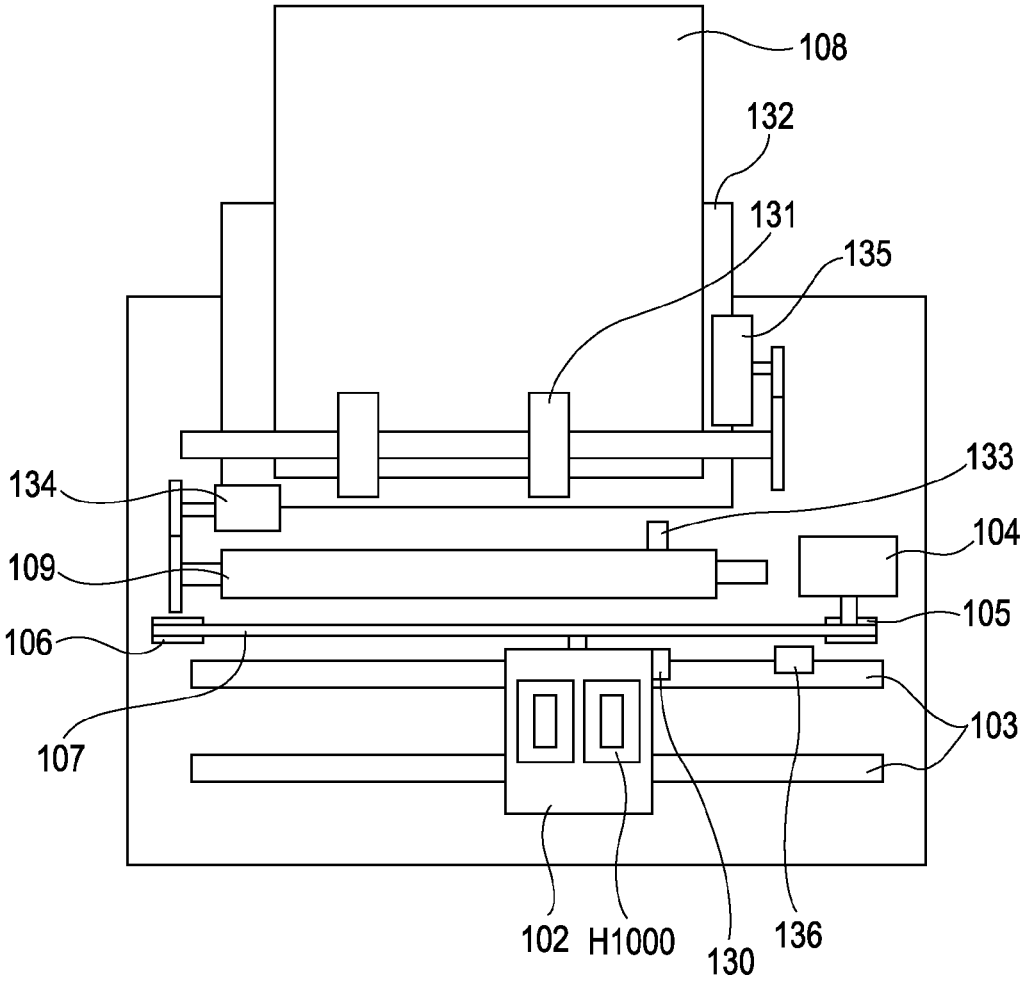
FIG. 5 schematically illustrates a recording device equipped with the recording head.

An example of a recording device in which the aforementioned cartridge-type recording head H1000 can be installed will now be described. FIG. 5 schematically illustrates an example of the recording device according to this embodiment. In FIG. 5, a recording medium 108 set in the recording device is also shown.

The recording head H1000 is fitted in a replaceable manner to a carriage 102 equipped in the recording device while being positioned with respect to the carriage 102. The carriage 102 is provided with an electrical connection section for transmitting a driving signal to the respective recording elements H1103 via the external-signal input terminal H1302 of the recording head H1000.

A guide shaft 103 extending in one direction is set in the recording device. The carriage 102 is supported in a movable fashion in a direction (i.e., the main scanning direction) parallel to the guide shaft 103. The carriage 102 is driven by a scan motor 104 via a driving mechanism including a motor pulley 105, a driven pulley 106, and a timing belt 107. Thus, the position and the movement of the carriage 102 are controlled.

The carriage 102 is provided with a home-position sensor 130. The home-position sensor 130 is configured to detect a shield plate 136 disposed at a predetermined position in a movement path of the carriage 102. A position at which the home-position sensor 130 is substantially aligned with the shield plate 136 is the home position of the carriage 102.

The recording device has an auto sheet feeder (ASF) 132 that separates and feeds recording media 108, such as printing sheets or thin plastic sheets, one by one. The ASF 132 has a pickup roller 131 that is rotationally driven by a feed motor 135 via a gear.

The recording device also has a conveying roller 109. When the conveying roller 109 rotates, the recording medium 108 is conveyed in a direction (sub scanning direction) substantially orthogonal to the main scanning direction while being moved through a position (referred to as "printing area" hereinafter) facing the nozzle face of the recording head H1000.

The conveying roller 109 is rotated when a rotational force of an LF motor 134 is transmitted thereto via a gear.

A conveying path of the recording medium 108 is provided with a paper-end sensor 133 that detects the position of an end of the recording medium 108. A detection signal indicating whether or not the recording medium 108 has moved past the paper-end sensor 133 is used for determining whether the recording medium 108 has been fed or for confirming the leading-end position of the recording medium 108 during the feeding process.

This paper-end sensor 133 can also be used for detecting the actual trailing-end position of the recording medium 108 so as to ultimately determine the current recording position from the actual trailing-end position.

The recording medium 108 is supported by a platen (not shown) in the printing area. Thus, the recording medium 108 when in the printing area can be held in a flat position.

In this case, the recording head H1000 fitted to the carriage 102 is held such that the nozzle face protrudes downward from the carriage 102 so as to face the recording medium 108.

The nozzles H1107 in the recording head H1000 are arranged in an array in the sub scanning direction. While the carriage 102 holding the recording head H1000 moves in the main scanning direction, liquid is ejected from the nozzles H1107 so that recording is performed on the recording medium 108.

Although this embodiment described above is directed to a so-called side-shooter-type recording head in which the recording elements H1103 and the nozzles H1107 are disposed facing each other, the configuration of the recording head is not limited to this example, and various modifications are permissible. Furthermore, the recording head does not necessarily need to be of a cartridge type.

Second Embodiment

A recording head according to a second embodiment differs from the recording head according to the first embodiment in the shape of the groove H1200 formed in the passage-forming member H1101 included in the recording-element substrate H1051.

The basic configuration of the recording head according to this embodiment is similar to that of the first embodiment.

Figure 6A:
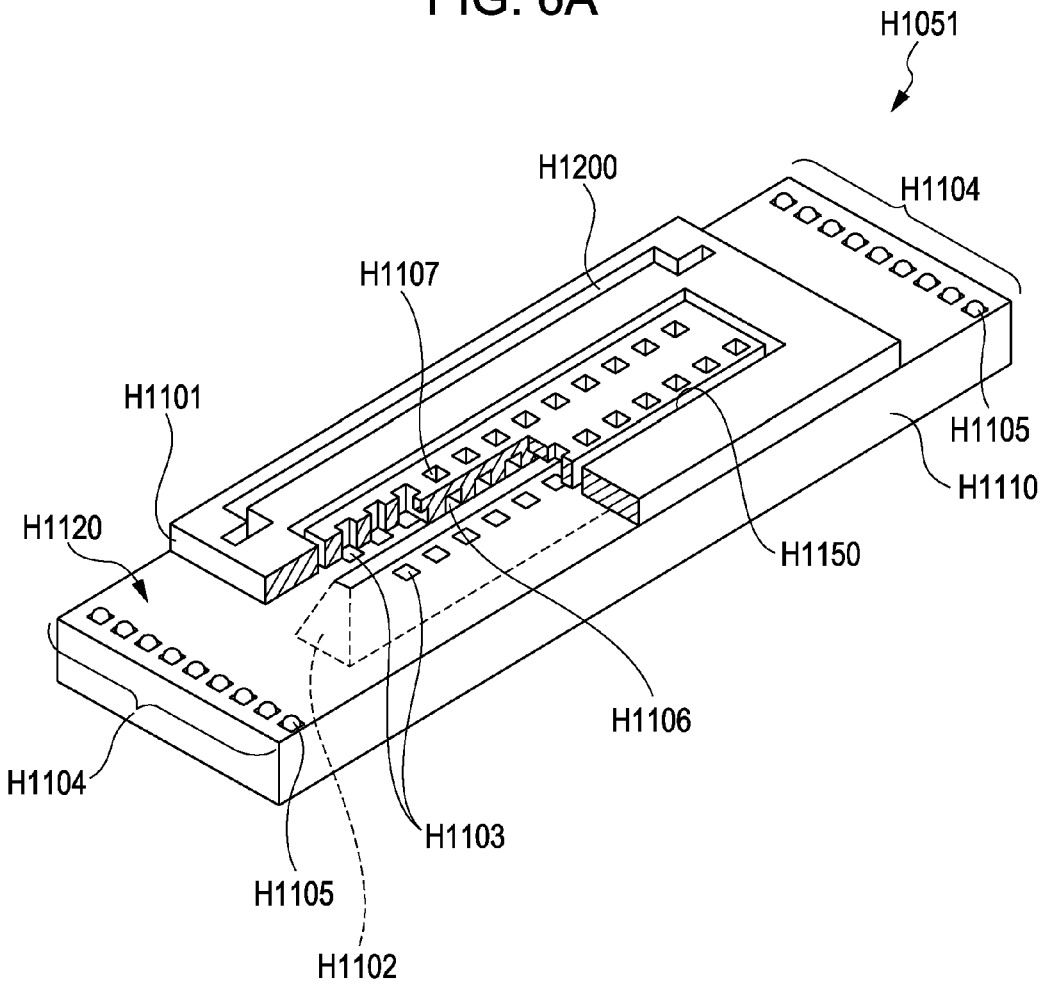
FIG. 6A is a partial-cutaway perspective view schematically showing a recording-element substrate included in a recording head according to a second embodiment.
Figure 6B:
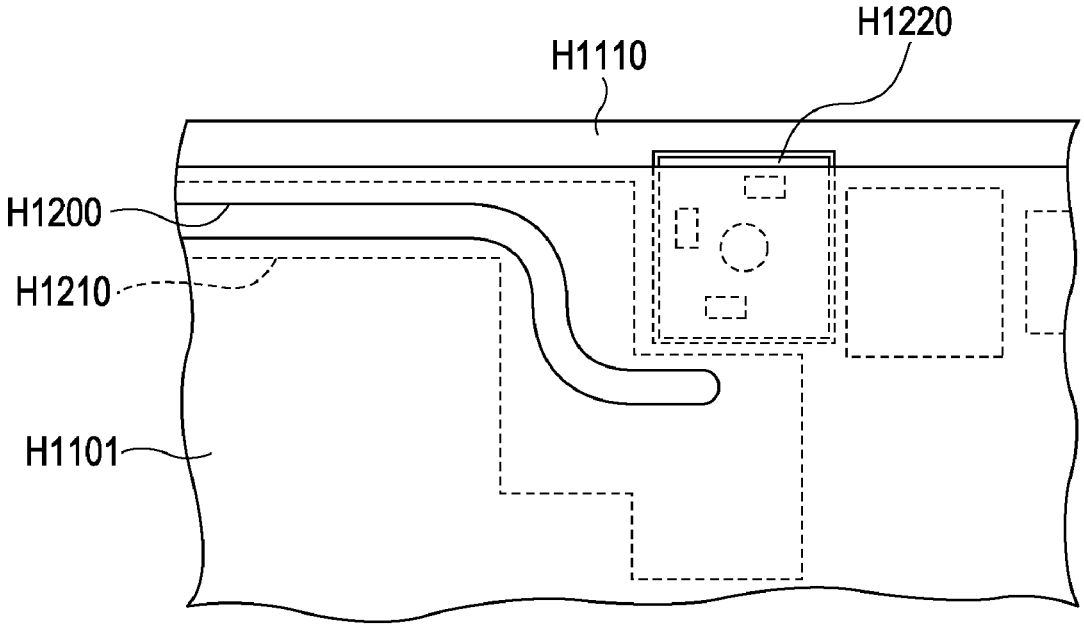
FIG. 6B is a plan view schematically showing the recording-element substrate, as viewed toward a nozzle face thereof.

FIG. 6A is a partial-cutaway perspective view schematically showing a recording-element substrate according to this embodiment. FIG. 6B is a plan view schematically showing the recording-element substrate, as viewed toward the nozzle face thereof.

The recording-element substrate H1051 is provided with the alignment mark H1220 used for positioning the recording-element substrate H1051 with respect to the holding member H1500 of the recording device.

The electrical wiring H1210 is formed adjacent to an edge of the substrate H1110 in a direction orthogonal to the longitudinal direction thereof. Although the electrical wiring H1210 extends in the longitudinal direction, the electrical wiring H1210 is provided in an area free of the alignment mark H1220 so as not to overlap the alignment mark H1220.

In this embodiment, the groove H1200 formed in the recording-element substrate H1051 by a through-hole extending through the passage-forming member H1101 similarly extends along the electrical wiring H1210. In detail, the bottom face of the groove H1200 is located at the top face H1122 of the projection H1121 formed on the one face H1120 of the substrate H1110.

Consequently, the groove H1200 has a bent section that prevents it from overlapping the alignment mark H1220 so that the positioning process can be performed without trouble when joining the recording-element substrate H1051 to the holding member H1500.

In this embodiment, the groove H1200 has a width of, for example, about 63.5 μm.

When the groove H1200 has a bent section, as mentioned above, it is preferable that the bent section have a shape of a smooth curve. The reason is that stress concentrated in the bent section can conceivably be alleviated, as compared with a bent section given, for example, a right angle.

In this embodiment, the bent section of the groove H1200 has an arc shape, such that the inside radius of the arc is about 51.5 μm and the outside radius is about 81.5 μm.

The electrode units H1104 provided in the recording-element substrate H1051 are electrically joined to the electrical-wiring tape H1300 when joining the recording-element substrate H1051 to the holding member H1500 (see FIG. 4). Subsequently, the electrode units H1104 and the vicinity thereof are sealed by a sealant (not shown) containing epoxy resin as a main component.

Therefore, it is preferable that the two longitudinal ends of the groove H1200 be spaced apart from the respective electrode units H1104 by sufficient distances to prevent the sealant from flowing into the groove H1200.

A recording head was actually fabricated using the above-described recording-element substrate H1051 to examine the degree of detachment of the passage-forming member H1101. According to a detailed examination implemented on the fabricated recording head, no significant detachment was found at the edges of the bottom face of the passage-forming member H1101.

The same test as described in the first embodiment was implemented on the recording head according to this embodiment. The electrical wiring H1210 was examined in detail but was confirmed to have no corrosion.

Third Embodiment

A recording head according to a third embodiment differs from the recording head according to the first embodiment in the shape of the groove H1200 formed in the passage-forming member H1101 included in the recording-element substrate H1051.

Figure 7A:
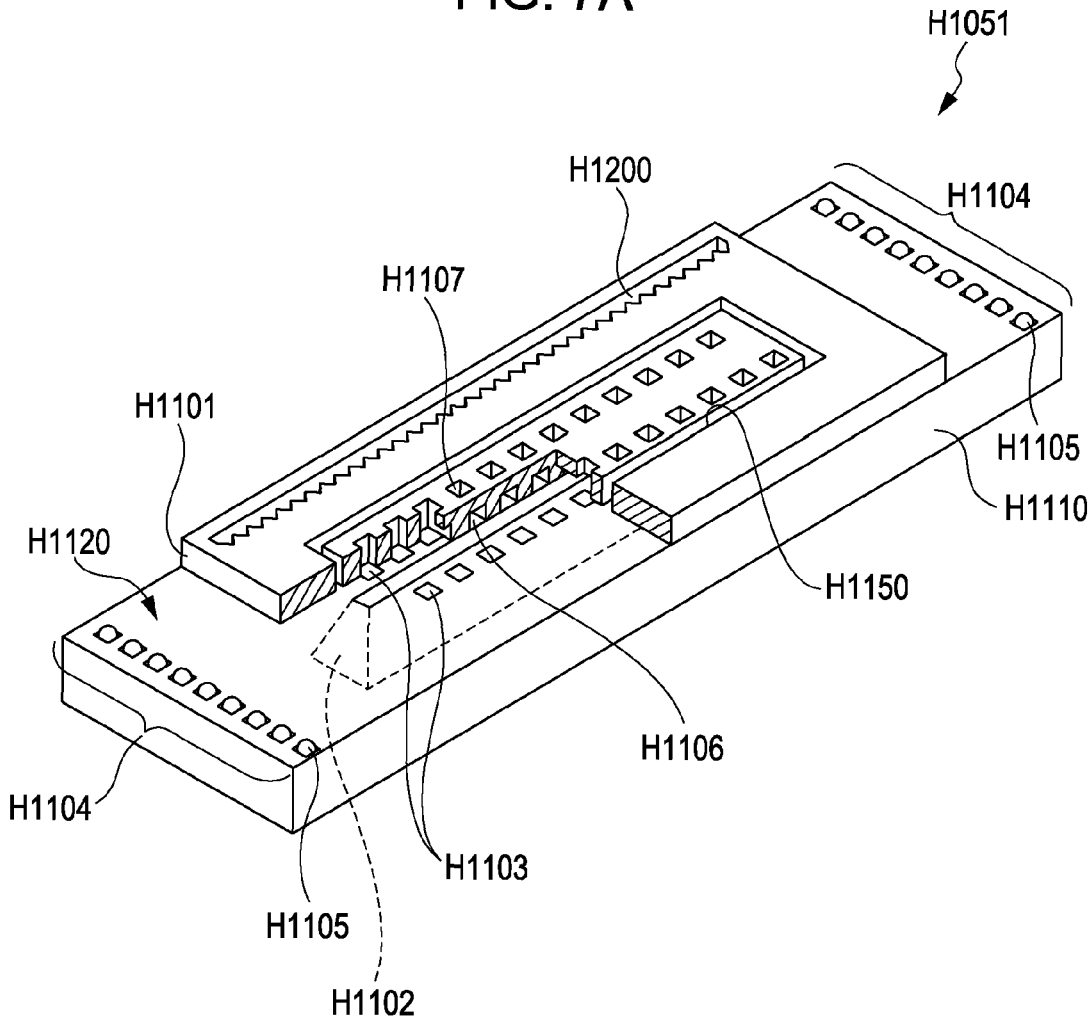
FIG. 7A is a partial-cutaway perspective view schematically showing a recording-element substrate included in a recording head according to a third embodiment.
Figure 7B:
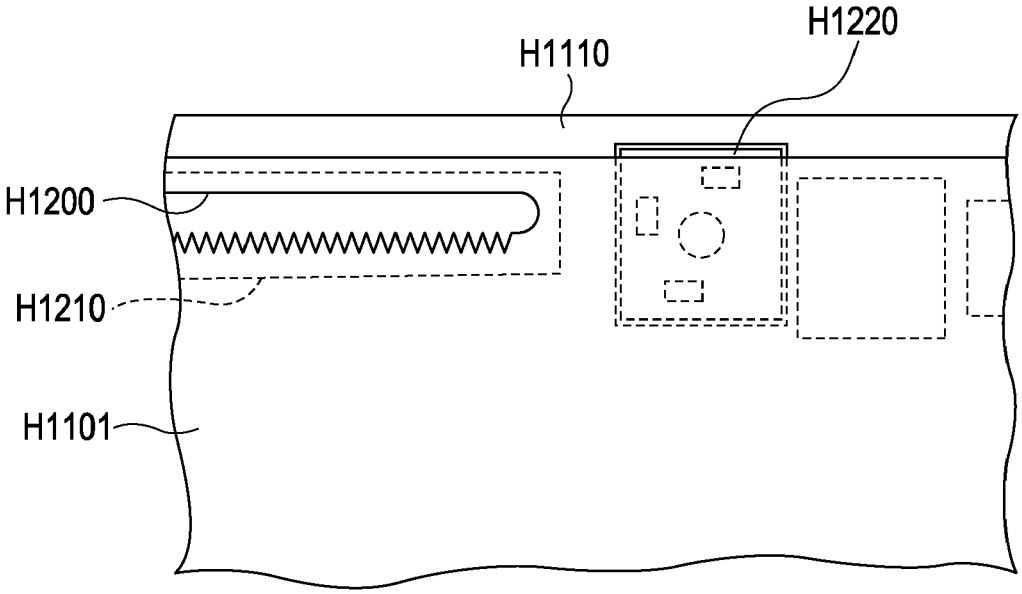
FIG. 7B is a plan view schematically showing the recording-element substrate, as viewed toward a nozzle face thereof.

The basic configuration of the recording head according to this embodiment is similar to that of the first embodiment. FIG. 7A is a partial-cutaway perspective view schematically showing a recording-element substrate according to this embodiment. FIG. 7B is a plan view schematically showing the recording-element substrate, as viewed toward the nozzle face thereof.

The groove H1200 formed in the passage-forming member H1101 is similar to that in the first embodiment in that it extends along the electrical wiring H1210. The groove H1200 is provided adjacent to one edge of the passage-forming member H1101 in the direction orthogonal to the longitudinal direction thereof.

One of the side faces of the groove H1200 is serrated. In this embodiment, the side face of the groove H1200 that is located closer to the central region (i.e., the region with the nozzles) of the recording-element substrate H1051 is serrated.

For example, in this embodiment, each serration has a height of about 15 μm, and the serrations are arranged at intervals of about 21 μm. The maximum value of the width of the groove H1200 in the direction orthogonal to the longitudinal direction is about 35 μm, whereas the minimum value of the width of the groove H1200 in the direction orthogonal to the longitudinal direction is about 20 μm.

As an alternative to this embodiment, the side faces of the groove H1200 may entirely be serrated.

A recording head was actually fabricated using the above-described recording-element substrate H1051 to examine the degree of detachment of the passage-forming member H1101. According to a detailed examination implemented on the fabricated recording head, slight detachment was confirmed at the edges of the bottom face of the passage-forming member H1101. In detail, the passage-forming member H1101 was slightly detached at the ends of the serrations.

However, the degree of detachment of the passage-forming member H1101 was small as compared with the recording head H1000 according to the first embodiment. The detached area of the passage-forming member H1101 did not extend to the positions corresponding to the side faces of the projection H1121.

The same test as described in the first embodiment was implemented on the recording head according to this embodiment. The electrical wiring H1210 was examined in detail but was confirmed to have no corrosion.

By giving the groove H1200 a serrated side face or serrated side faces in this manner, the degree of detachment of the passage-forming member H1101 can be reduced. This can further minimize corrosion of the electrical wiring, whereby a recording head with higher reliability can be provided.

Although the above embodiments are directed to an example in which a single groove H1200 is provided, the present invention is not limited to this example. For example, the passage-forming member H1101 may be provided with a plurality of through-holes extending continuously along the electrical wiring H1210.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-194873 filed Jul. 29, 2008, which is hereby incorporated by reference herein in its entirety.

What is claimed is:

1. A recording head comprising:

a substrate provided with a recording element that generates energy for ejecting liquid and electrical wiring that supplies power to the recording element; and a passage-forming member provided in contact with one face of the substrate and having a nozzle for ejecting the liquid and a passage for supplying the liquid to the nozzle, wherein a groove formed by a through-hole provided in the passage-forming member is disposed such that a bottom face of the groove is located along and above the electrical wiring and positioned so as not to overlap an edge of the electrical wiring.

2. The recording head according to claim 1, wherein the one face of the substrate is provided with a projection formed due to the electrical wiring, and wherein the groove is disposed such that the bottom face thereof does not overlap a side face of the projection.

3. The recording head according to claim 1, wherein the groove has a width smaller than that of the electrical wiring.

4. The recording head according to claim 1, wherein the groove extends in a longitudinal direction of the passage-forming member.

5. The recording head according to claim 4, wherein the groove is provided adjacent to an edge of the passage-forming member in a direction orthogonal to the longitudinal direction of the passage-forming member.

6. The recording head according to claim 1, wherein a side face of the groove is serrated.

7. The recording head according to claim 1, wherein the one face of the substrate is provided with a protective film.

8. The recording head according to claim 1, wherein the passage-forming member is composed of resin.

9. The recording head according to claim 1, wherein the groove has a bent section having a curved shape.

10. The recording head according to claim 1, wherein the through-hole is provided in a plurality.

* * * * *